US011720063B2

(12) United States Patent
Monferrer et al.

(10) Patent No.: US 11,720,063 B2
(45) Date of Patent: Aug. 8, 2023

(54) SYSTEM FOR FASTENING AND/OR EXTRACTING A DIAL

(71) Applicant: Blancpain SA, Le Brassus (CH)

(72) Inventors: Bernat Monferrer, St-Prex (CH); Orane Romano, Les Rousses (FR)

(73) Assignee: Blancpain SA, Le Brassus (CH)

( * ) Notice: Subject to any disclaimer, the term of this patent is extended or adjusted under 35 U.S.C. 154(b) by 456 days.

(21) Appl. No.: 17/075,786

(22) Filed: Oct. 21, 2020

(65) Prior Publication Data

US 2021/0132548 A1 May 6, 2021

(30) Foreign Application Priority Data

Nov. 5, 2019 (EP) ..... 19207244

(51) Int. Cl.
*G04D 3/00* (2006.01)
*G04B 19/14* (2006.01)

(52) U.S. Cl.
CPC ..... *G04B 19/14* (2013.01); *G04D 3/0048* (2013.01)

(58) Field of Classification Search
CPC ..... G04B 19/06; G04B 19/14; G04B 19/16; G04D 3/0048
See application file for complete search history.

(56) References Cited

U.S. PATENT DOCUMENTS 2,132,051 A * 10/1938 Schuttenberg ..... G04B 37/125 40/107
4,660,992 A * 4/1987 Paul ..... G04B 19/06 968/147
5,018,118 A * 5/1991 Ross ..... G04B 19/02 368/228
5,224,078 A * 6/1993 Mallin ..... G04B 45/0092 368/228

(Continued)

FOREIGN PATENT DOCUMENTS

CH 488 218 A 8/1969
CN 105393174 A 3/2016

(Continued)

OTHER PUBLICATIONS

Combined Chinese Office Action and Search Report dated Sep. 2, 2021 in Chinese Patent Application No. 202011226455.7 (with English translation), citing documents AO through AQ therein, 12 pages.

(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A system for fastening and/or extracting a dial disposed on a support. The dial includes a holding portion configured to bring the dial against the support and an extracting portion configured to move the dial away from the support. The (Continued)

system includes a movable organ configured to displace or be displaced between a fastening position and an extraction position. The movable organ includes a holding surface configured to cooperate with the holding portion so as to bring the dial against the support and an extraction surface configured to cooperate with the extraction portion so as to move the dial away from the support.

9 Claims, 3 Drawing Sheets

(56) References Cited

U.S. PATENT DOCUMENTS

| | | | | |
|---|---|---|---|---|
| 5,793,710 | A * | 8/1998 | Jacobi, Jr. | G04B 19/06 368/228 |
| 6,118,735 | A * | 9/2000 | Li | G04B 19/06 368/232 |
| 7,177,234 | B1 * | 2/2007 | Paul | G04B 45/0092 368/88 |
| 8,879,368 | B2 * | 11/2014 | Jacobi, Jr. | G04B 19/14 368/232 |
| 11,048,211 | B2 * | 6/2021 | Kojima | G04B 19/06 |
| 2004/0141423 | A1 * | 7/2004 | Hurni | G04B 19/06 368/232 |

FOREIGN PATENT DOCUMENTS

| | | |
|---|---|---|
| CN | 208969442 U | 6/2019 |
| GB | 154858 | 12/1920 |
| JP | 50-15509 | 5/1975 |
| JP | 52-151054 | 11/1977 |
| JP | 57-64686 | 4/1982 |

OTHER PUBLICATIONS

European Search Report dated May 12, 2020 in European Application 19207244.5 filed Nov. 5, 2019 (with English Translation of Categories of Cited Documents & Written Opinion), citing documents AO-AR therein, 11 pages.

* cited by examiner

SYSTEM FOR FASTENING AND/OR EXTRACTING A DIAL

CROSS-REFERENCE TO RELATED APPLICATION

This application claims priority to European Patent Application No. 19207244.5 filed on Nov. 5, 2019, the entire disclosure of which is hereby incorporated herein by reference.

TECHNICAL FIELD

The field of the present invention relates to that of watchmaking and more particularly that of fastening systems for fastening levers.

TECHNOLOGICAL BACKGROUND

The field of watchmaking is a field which requires a great deal of precision on the one hand and on the other hand wherein the space available is limited, which increases the difficulty of accessing some parts of the horological wheel.

Indeed, in some cases, some parts are difficult to access or even inaccessible unless several parts or wheels are disassembled in order to reach the desired part.

SUMMARY OF THE INVENTION

The present invention proposes to totally or partially overcome these disadvantages by means of a fastening and/or extraction system fore dial, and preferably of a dial; said dial being disposed on a support and preferably on a first face of said support and comprising at least one holding portion configured to bring said dial against said support and/or at least one extraction portion configured to move said dial away from said support; said system comprising at least one movable organ configured to displace or be displaced between at least one fastening position and at least one extraction position and including at least:

- one holding surface, said at least one holding surface being configured to cooperate with said at least one holding portion so as to bring said dial against said support when said at least one movable organ displaces or is displaced between said fastening position and said extraction position; and,
- one extraction surfaces said at least one extraction surface being configured to cooperate with said at least one extraction portion so as to move said dial away from said support when said at least one movable organ displaces or is displaced between said fastening position and said extraction position.

Thanks to this arrangement, it is possible to fasten the dial by means of the movable organ accessible outside the movement and reaching the dial.

According to one embodiment, said at least one movable organ is at least one lever pivoting about at least one pivot axis between said fastening position and said extraction position.

According to one embodiment, said pivot axis is made by a fastening organ, preferably by a screw, a rivet and/or a pin.

Thanks to either of this arrangement, the movable organ can pivot about a pivot axis.

According to one embodiment, the movable organ includes at least one holding arm and at least one extraction arm; said at least one holding surface is disposed on said at least one holding arm and/or said at least one extraction surface is disposed on said at least one extraction arm.

Thanks to this arrangement, the holding arm and the extraction arm allow the holding and extraction of the dial respectively.

According to one embodiment, said at least one holding arm and said at least one extraction arm are facing each other and/or separated by a space.

According to one embodiment, said at least one holding arm and said at least one extraction arm are on either side of said at least one movable organ.

Thanks to one of these arrangements, holding arm and the extraction arm can hold and extract the dial respectively when the movable organ displaces between the two positions and preferably between the fastening position and the extraction position.

According to one embodiment, the system comprises at least one movable stop configured to displace said at least one movable organ between said fastening position and said extraction position.

Thanks to this arrangement, the movable stop displaces the movable organ between the fastening position and the extraction position.

According to one embodiment, the system comprises at least one return element configured to displace said at least one movable organ between said fastening position, and said extraction position and preferably to displace said at least one movable organ to said fastening position.

According to one embodiment, the return element is configured to deform elastically.

Thanks to one of these arrangements, the return element displaces the movable organ between the fastening position and the extraction position so as to press the movable organ in the holding position.

According to one embodiment, said at least one return element is totally or partially housed in said at least one movable organ and/or said movable organ comprises at least one groove configured to totally or partially house said at least one return element.

Thanks to this arrangement, a gain in volume is achieved.

According to one embodiment, said at least one holding surface is facing said at least one extraction surface, preferably, the normal to said at least one holding surface is parallel and/or coaxial to the normal to said at least one extraction surface.

Thanks to this arrangement, the holding surface and the extraction surface can hold and extract the dial respectively when the movable organ displaces between the two positions and preferably between the fastening position and the extraction position.

According to one embodiment, said at least one holding surface is configured to conform to said at least one holding portion and/or said at least one extraction surface is configured to conform to said at least one extraction portion.

According to one embodiments the system comprises said support and wherein said at least one movable organ is disposed on said support and preferably on a second surface in particular opposite to said first surface.

Thanks to this arrangement, the dial and the movable organ hold each other on either side of the support.

The embodiments and the variants mentioned above can be taken separately or in any technically possible combination.

The present invention will be well understood and its advantages will also emerge in light of the description which follows, given only by way of a non-limiting example and made with reference to the appended figures, wherein identical reference signs correspond to structurally and/or functionally identical or similar elements.

BRIEF DESCRIPTION OF THE FIGURES

The invention will be described in more detail below using the appended drawings, given by way of non-limiting examples, wherein.

DETAILED DESCRIPTION OF THE INVENTION

Figure 1A:
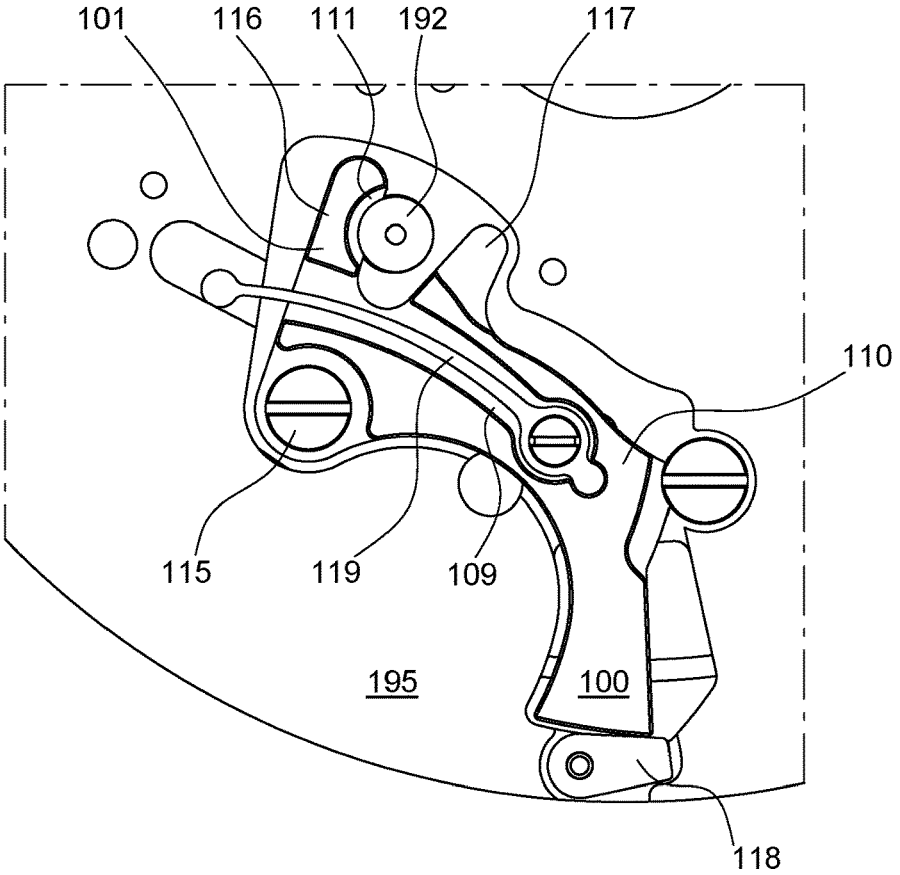
FIGS. 1A to 1C illustrate an embodiment of a system (100) for fastening and/or extracting a dial (190) in a fastening position (101)

The present invention allows, despite the limited space available, access to some parts which are difficult to access.

The present invention is in the form of a fastening and or extraction system 100 for a dial 190, preferably of a dial 190. This system comprises a holding surface 111 and an extraction surface 112. It is these surfaces which will allow said dial to be held against a support 195 or extracted from the support 195.

Indeed, the dial 190 can be disposed on the support 195 and preferably on a first face 196 of the support 195 just like the movable organ 110. According to the embodiments, the support 195 may comprise a second surface or a second face, in particular opposite to the first surface, on which the movable organ 110 can be disposed so that the dial 190 and the movable organ 110 hold each other on either side of the support 195.

Figure 1B:
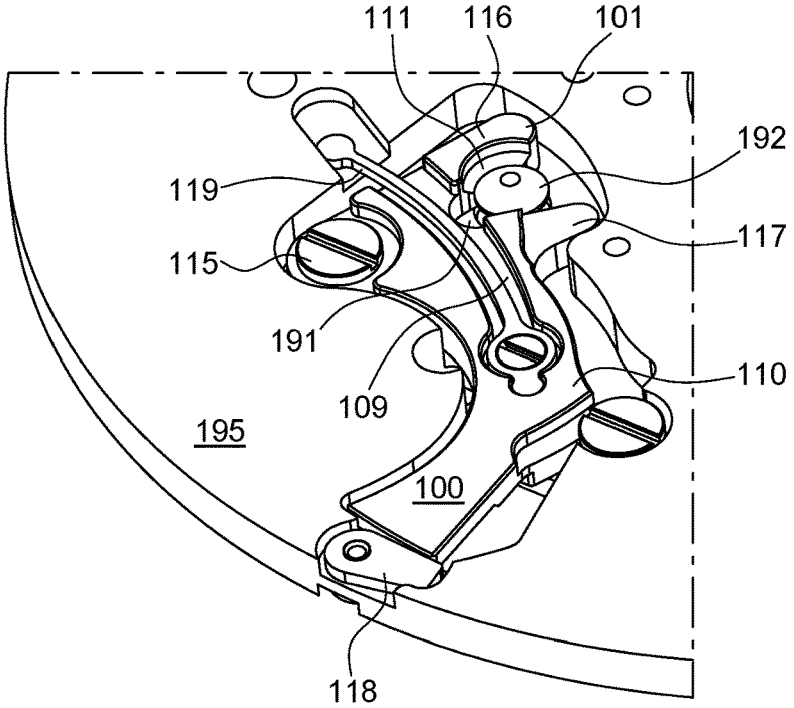
Figure 1C:
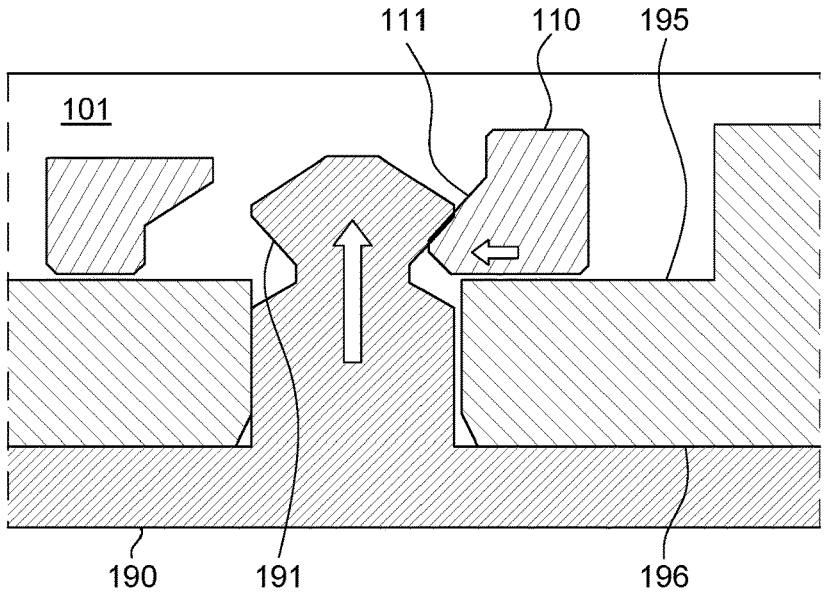

As shown in FIGS. 1A and 1B, the dial 190 comprises a holding portion 191 configured to bring the dial 190 against the support 195 and/or an extraction portion 192 configured to move the dial 190 away from the support 195.

The system 100 may comprise a movable organ 110 configured to displace or be displaced between a fastening position 101 and an extraction position 102. This movable organ 110 may take the shape of a lever 110 configured to pivot about a pivot axis 116 between the fastening position 101 and the extraction position 102. The holding surface 111 and/or the extraction surface 112 may be located on this same movable organ 110. Indeed, according to one embodiment shown in FIGS. 1A-2C, the movable organ 110 may include a holding arm 116 and an extraction arm 117 on which the holding surface 111 and the extraction surface 112 are respectively disposed so that the holding arm 116 and extraction arm 117 allow the holding and extraction of the dial 190.

This holding surface 111 may be facing the extraction surface 112, preferably, the normal to the holding, surface 111 is parallel and/or coaxial to the normal of the extraction surface 112 so that it/they can hold and/or extract the dial 190 respectively when the movable organ 110 displaces between the two positions and preferably between the fastening position 101 and the extraction position 102.

Preferably, and as can be seen in FIGS. 1A-2C, the holding surface can be configured to conform to the holding portion 191 and the extraction surface 112 can be configured to conform to the extraction portion 192.

This holding surface 111 is configured to cooperate with the holding portion 191 so as to bring the dial 190 against the support 196 when the movable organ 110 displaces or is displaced between the fastening position and the extraction position 102, which allows to fasten the dial 190 by means of the movable organ 110 to the support 195 and preferably to the first face 196 of the support 195. Indeed, when the movable organ 110 displaces or is displaced from the extraction position 102 to the fastening position 101, the holding surface 111 contacts, the holding portion 191 and presses or preferably brings the dial 190 against the support 195, as can be seen in FIGS. 1A and 1B. This allows the user to bring the dial 190 by means of the movable organ 110 against the support 195, without having to assemble or reassemble the peripheral parts necessary to hold the movement.

Figure 2A:
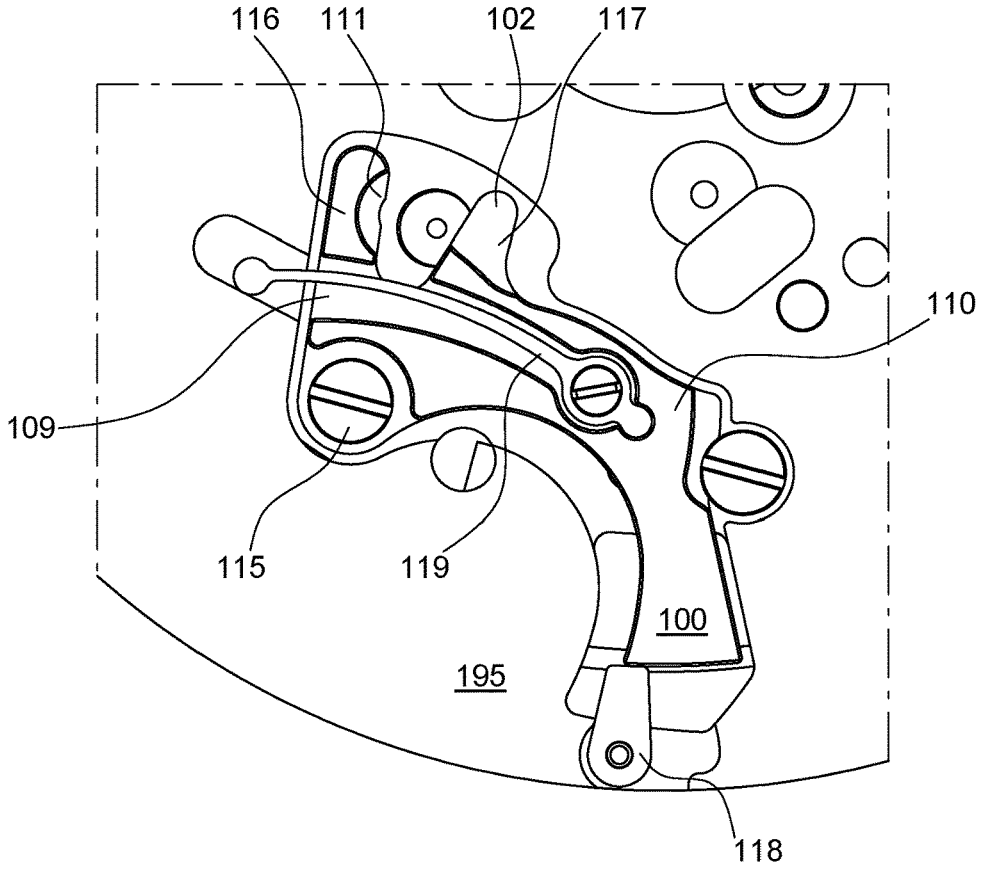
FIGS. 2A-2C show an embodiment of a system (100) for fastening and/or extracting a dial (190) in an extraction position (102).
Figure 2B:
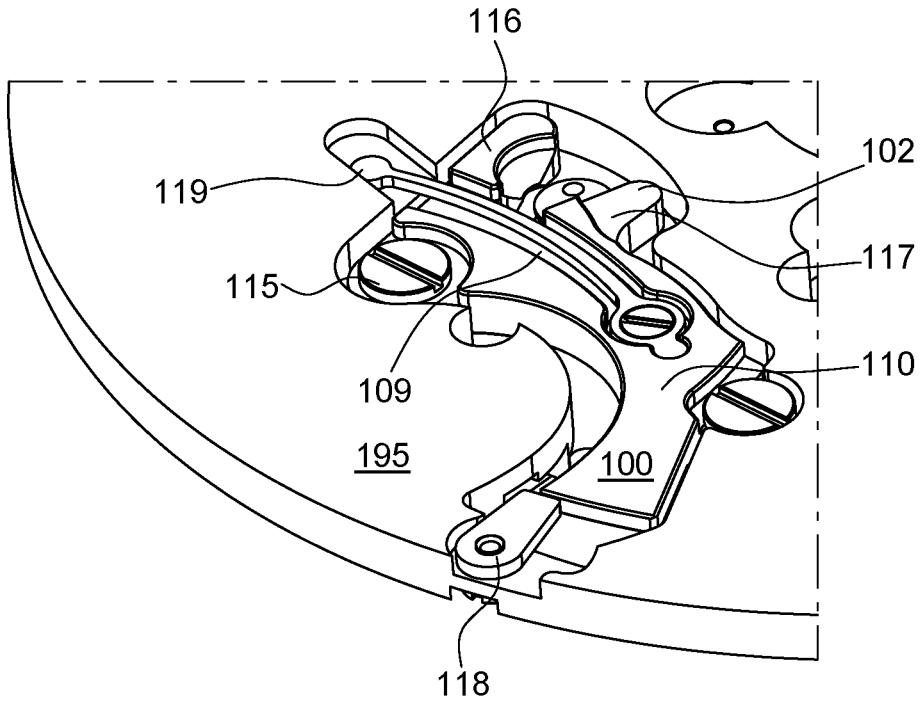
Figure 2C:
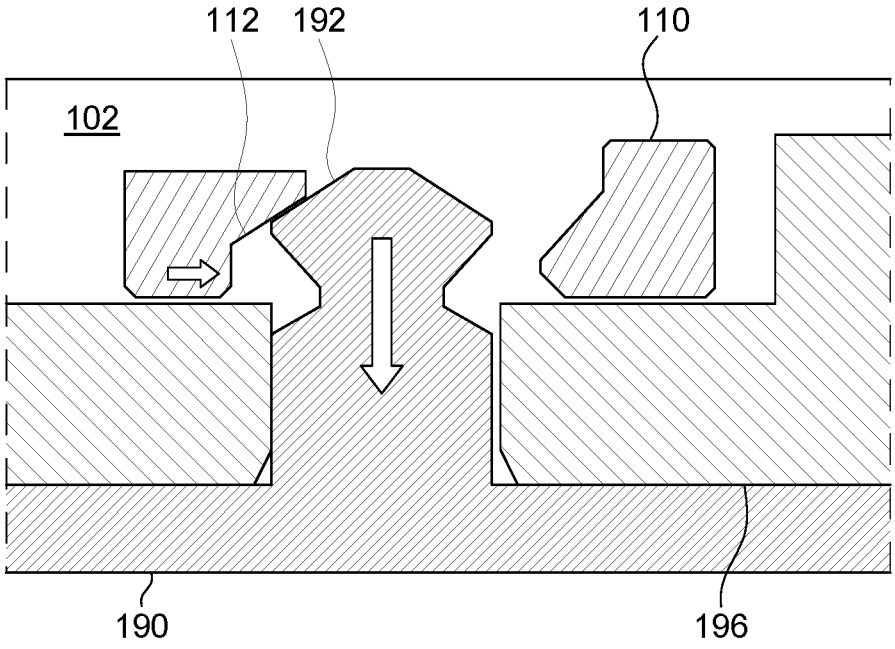

The extraction surface 112, in turn, is configured to cooperate with the extraction portion 192 so as to move the dial 190 away from the support 195 when the movable organ 110 displaces or is displaced between the fastening position 101 and the extraction position 102, which allows the dial 190 to be moved away. Indeed, when the movable organ 110 displaces or is displaced from the fastening position 101 to the extraction, position 102 the extraction surface 112 contacts the extraction portion 192 and pushes or preferably moves away the dial 190 from the support 195, as can be seen in FIGS. 2A and 2B. This allows the user to move the dial 190 away by means of the movable organ 110 without having to disassemble other parts that would be connected to the movement.

As mentioned above, the movable organ 110 can take the shape of a lever 110 pivoting about the pivot axis 115 between the fastening position 101 and the extraction position 102. This pivoting is induced by a movable stop 118 which allows the displacement of the movable organ 110 between the fastening position 101 and the extraction position 102.

Indeed, like the example shown in FIGS. 1A, and 2A or 1B and 2B, the movable stop 118, shown in an oblong shape, comprises a centre of rotation about which the movable stop 118 can rotate. To this is added a proximal end of rounded shape so as to be in the proximity of the periphery of the support 195 and close to the centre of rotation, and a distal end distant from the centre of rotation and configured to be in contact with the movable organ 110 and to displace the movable organ 110 between the fastening position the extraction position 102 and preferably from the fastening position 101 to the extraction position 102.

The displacement of the movable organ 110, from the extraction position 102 to the fastening position 101, may not take place when the movable stop 118 returns to its main position which corresponds to the fastening position 101 for the movable organ 110 due to the possible frictional force exerted by the support on the movable organ 110. This is why the system 100 can comprise a return element 119, according to the embodiments, which can be elastically deformed and being configured to displace the movable organ 110 between the fastening position 101 and the extraction position 102 and preferably to displace the movable organ 110 from the extraction position 102 to the fastening position 101 so as to press the movable organ in the holding position, that is to say the fastening position 101.

This return element 119 may be totally or partially housed in the movable organ 110 or, according to one embodiment, the movable organ 110 may comprise a groove 109 configured to totally or partially house the return element 119 so as to reduce the bulk of the return element 119 in the fastening and/or extraction system 100.

The invention claimed is:

1. A fastening and/or extraction system for a dial, said dial being disposed on a support and on a first face of said support and comprising at least one holding portion configured to bring said dial against said support and/or at least one extraction portion configured to move said dial away from said support; said system comprising at least one movable organ configured to displace or be displaced between at least one fastening position and at least one extraction position and including at least:

one holding surface; said at least one holding surface being configured to cooperate with said at least one holding portion so as to bring said dial against said support when said at least one movable organ displaces or is displaced between said fastening position and said extraction position; and, one extraction surface; said at least one extraction surface being configured to cooperate with said at least one extraction portion so as to move said dial away from said support when said at least one movable organ displaces or is displaced between said fastening position and said extraction position.

2. The system according to claim 1, wherein said at least one movable organ is at least one lever pivoting about at least one pivot axis between said fastening position and said extraction position.

3. The system according to claim 1, wherein the movable organ comprises at least one holding arm and at least one extraction arm; said at least one holding surface is disposed on said at least one holding arm and/or said at least one extraction surface is disposed on said at least one extraction arm.

4. The system according to claim 1, further comprising at least one movable stop configured to displace said at least one movable organ between said fastening position and said extraction position.

5. The system according to claim 1, further comprising at least one return element configured to displace said at least one movable organ between said fastening position and said extraction position and to displace said at least one movable organ to said fastening position.

6. The system according to claim 1, wherein said at least one return element is totally or partially housed in said at least one movable organ and/or said movable organ comprises at least one groove configured to totally or partially house said at least one return element.

7. The system according to claim 1, wherein said at least one holding surface is facing said at least one extraction surface, the normal to said at least one holding surface is parallel and/or coaxial to the normal to said at least one extraction surface.

8. The system according to claim 1, wherein said at least one holding surface is configured to conform to said at least one holding portion and/or said at least one extraction surface is configured to conform to said at least one extraction portion.

9. The system according to claim 1, further comprising said support and wherein said at least one movable organ is disposed on said support and preferably on a second surface in particular opposite to said first surface.

* * * * *